US005355903A

United States Patent [19]

Haddad et al.

[11] Patent Number: 5,355,903

[45] Date of Patent: Oct. 18, 1994

[54] UMBRELLA

[76] Inventors: Joseph F. Haddad; Joseph R. Haddad, both of 18 Powder Horn Way, Berkeley Heights, N.J. 07922

[21] Appl. No.: 206,015

[22] Filed: Mar. 4, 1994

Related U.S. Application Data

[62] Division of Ser. No. 734,223, Jul. 22, 1991, Pat. No. 5,307,827.

[51] Int. Cl.[5] ..... A45B 11/00

[52] U.S. Cl. ..... 135/20.1; 135/29; 135/31; 403/83; 403/85

[58] Field of Search ..... 135/16, 20.1, 25.3, 135/31, 29, 15.1, 20.3, 25.31; 403/102, 109, 85, 83, 63

[56] References Cited

U.S. PATENT DOCUMENTS

| | | |
|---|---|---|
| 2,024,105 | 12/1935 | Landman . |
| 2,736,375 | 2/1956 | Rupert . |
| 4,007,752 | 2/1977 | Weber . |
| 4,641,675 | 2/1987 | Wu . |
| 4,711,260 | 12/1987 | Wiens et al. . |
| 4,760,610 | 8/1988 | Wu et al. . |
| 4,838,290 | 6/1989 | WU . |
| 4,861,090 | 8/1989 | Gavrieli . |
| 4,923,239 | 5/1990 | Wischusen et al. . |

FOREIGN PATENT DOCUMENTS

| | | | |
|---|---|---|---|
| 2254714 | 5/1974 | Fed. Rep. of Germany | 135/25.3 |
| 2351625 | 11/1974 | Fed. Rep. of Germany . | |
| 3809873 | 10/1989 | Fed. Rep. of Germany | 135/25.3 |
| 0372882 | 11/1939 | Italy . | |
| 1279591 | 12/1986 | U.S.S.R. | 135/25.3 |
| 0017429 | 9/1994 | United Kingdom . | |

*Primary Examiner*—Carl D. Friedman
*Assistant Examiner*—Lan C. Mai
*Attorney, Agent, or Firm*—Mathews, Woodbridge & Collins

[57] ABSTRACT

The present invention includes an umbrella which converts to at least two separate canopy configurations. The umbrella has a closed position, from which it can be opened and latched into at least one middle position. Such a middle position can be used as a car window shade to shade the car from sun entering the front windshield. Alternatively, the middle position can be a partially opened position latched in place for use as an umbrella in restricted places such as a seat in an open air stadium.

10 Claims, 16 Drawing Sheets

UMBRELLA

This is a division of application Ser. No. 07/734,223, filed Jul. 22, 1991 now U.S. Pat. No. 5,307,827.

BACKGROUND OF THE INVENTION

1. Field of the Invention

The present invention relates to an umbrella; more particularly, the present invention relates to an umbrella having a canopy which can be converted to and latched at different shapes.

2. Description of Related Art

Umbrellas are recognized articles of manufacture. The term umbrella itself is well defined. The New Lexicon Webster's Dictionary of the English Language, 1989 edition, Lexicon Publications, Inc., New York, defines "umbrella" to include, "a portable device which, when opened, is used to keep rain off a person or to protect him from the sun, . . . It consists of a circular canopy of cotton, silk etc. stretched across collapsible steel etc. ribs radiating from a center pole, the end of the pole forming a handle . . . ". The Random House, College Dictionary, Revised Edition 1975, Random House, Inc., 1975, defines "umbrella" as, "1. a light, small, portable, usually circular cover for protection from rain or sun, consisting of a fabric held on a collapsible frame of thin ribs radiating from the top of a carrying stick or handle.".

U.S. Pat. No. 4,711,260 is directed to an umbrella which converts into a golfing backstop. Initially, the umbrella is in a collapsed position. The umbrella then opens directly to the conventional, fully first open position for protection against the weather elements.

In this position the edges of the canopy extend downward toward the umbrella handle (concave toward the handle). The umbrella further may be opened into an over extended position. In this over extended position the canopy is inverted from the first open position and it extends upwardly from the umbrella handle. The surface assumes a concave configuration (away from the handle).

U.S. Pat. No. 2,736,375 discloses a protective shield for vehicle windshields and windows. This is constructed to be capable of being placed on the outside of the window to prevent accumulation of ice, snow, sleet, mud and the like on the windshields of automobile, trucks, airplane and the like when they are not in use. The shield can be made in various flexible sections which collapse around a common point in the center.

U.S. Pat. No. 4,861,090 discloses a fan-type automobile window shade. U.S. Pat. No. 4,923,239 discloses yet another design for a vehicle sun screen.

Both umbrellas and vehicle sun shades have become commonplace and are typically stored in automobiles. It would be desirable and convenient if one article could perform the function of both umbrella and a car window sun shade. While the two articles are often kept in an automobile, they are not used at the same time. When it is sunny there is no need for the umbrella and when it is raining there is no need for the sun screen.

SUMMARY OF THE INVENTION

The present invention includes an umbrella which converts to at least two separate canopy configurations. The umbrella has a closed position, from which it can be opened and latched into at least one middle position intermediate between the closed and the convention open position. Such a middle position can be used as a car window shade to shade the car from sun entering the front windshield. Alternatively, the middle position can be a partially opened position latched in place for use as an umbrella in restricted places such as a seat in an open air stadium. This, for example, can allow the sides and rear of the umbrella to only partially open so as not to interfere with adjacent fans. The umbrella then can be adjusted to a fully opened position having the conventional umbrella shape. Such a shape is typically a concave canopy held open by suitable handle means and being concave to the handle means.

The present invention also includes an umbrella, which in the open position has a canopy having a top section which extends generally radially from the shaft, and sides and a rear canopy section which extend generally vertically downward from the outer boundary of the top.

More particularly, the present invention can comprise a shaft comprising a handle end and a canopy end. There is a canopy comprising a plurality of canopy ribs. The ribs have a shaft end pivotally connected to the canopy end of the shaft and extending from the shaft to outer rib ends. The canopy has a canopy cover supported on the canopy ribs and extending from the shaft toward the outer rib ends. There is at least one multi-position canopy rib having at least one multi-position rib hinge between the shaft end and the outer rib end. There can be conventional extension ribs which can be collapsible. These ribs have only open and closed positions.

There is an actuating means for moving the canopy from a closed position where the canopy is collapsed to a middle position, and then to a fully opened position, or directly from the closed position to a fully opened position. By collapsed it is meant that the canopy ribs pivot to cause the outer rib ends to move into a position juxtaposed to the shaft. There is at least one middle position wherein the at least one multi-position rib is closed or partially opened. It is in this position that the canopy can take on a non-conventional umbrella application such as a car shade or a stadium umbrella shape. Finally, there is an open position wherein the multi-position ribs are fully axially extended so that the canopy is in an open position. In the open position, the canopy can extend generally radially from the shaft having a concave inner surface facing toward the handle of the shaft. The outer surface is correspondingly convex. The umbrella comprises a means to latch the umbrella with the multi-position rib in at least one middle position and further, a means to latch the umbrella in the fully open position.

In more preferred embodiments, the umbrella comprises at least one extension rib. The extension rib can be a conventional non-hinged rib, or a conventional collapsible umbrella extension rib. The extension rib has an extension rib shaft end pivotally connected to the canopy end of the shaft and radially extending from the shaft to the outer extension rib end. The extension rib fully opens in the middle position.

In a specific and preferred embodiment, the canopy comprises four radial sectors, each sector extending between two radii from the shaft. There is at least one multi-position rib in at least one sector and at least one extension rib in at least one sector. Preferably, there is an extension rib at the radial boundaries of each sector.

In the embodiment useful as a car shade, there are four extension ribs which meet at the shaft. The four extension ribs define adjacent and opposite sectors. Two, opposite hinged sectors each comprise at least one multi-position rib. There are two opposite sectors, each of which is adjacent to a hinged sector which are fixed, or shade, sectors. The shade sectors preferably have no multi-position ribs and so have only a single open position. When the umbrella is put into at least one of the middle positions, the multi-position ribs remain closed or partially open and the extension ribs fully open. In the middle position the portion of the multi-position rib between the multi-position rib hinge and the outer rib end (i.e., the end section) is at an angle to the portion of rib between the shaft and the hinge (i.e., the shaft section). Preferably, the angle is from 0° to 135° and more preferably from 0° to 90°. This prevents the canopy attached to the outer rib end of the multi-position rib from completely opening.

A segment of a hinged canopy sector is defined by the outer perimeter of the canopy cover and a line connecting the ends of the two extension ribs. In the middle position the segment is closed or partially open.

In a preferred car shade embodiment, the canopy cover can have the shape of a trapezoid in the middle position. The trapezoid has four sides, two opposite sides are on sectors having no multi-position rib. These are the shade sectors. There are two segmented sectors between the shade sectors which are opposite to each other. Each has at least one multi-position rib having a multi-position hinge located along the rib. Each multi-position hinge is preferably on a line connecting the extension rib ends which form the parallel sides of the trapezoid when partially opened. To fit a windshield the extension ribs defining one of the segmented sectors can be shorter than the extension ribs defining the opposing segmented sector. The radial boundaries of a segmented sector are preferably of equal length. The sector having longer extension ribs defines the longer side of a trapezoid when the umbrella is partially opened and the sector having the shorter extension ribs defines the shorter side of the trapezoid. The two ends of the trapezoid are defined by the perimeter circumference of the canopy between the short and long extension ribs.

More particularly, at least one multi-position canopy rib can comprise a shaft section between the shaft and the multi-position hinge and an end section between the multi-position hinge and the outer rib end. The multi-position rib hinge comprises a means to bend the end portion at an angle to the shaft portion of the rib. The multi-position rib hinge preferably has a means to rotate radially and axially to the shaft section of the rib. The canopy can be attached to the multi-position hinged rib at the outer rib end. The canopy is also attached to the canopy end of the shaft.

The present invention is possible in part because of the preferred multi-position hinge. The hinge comprises a hinge body, a restricter bar and a hinge piston. The restricter bar is pivotally connected at the hinge end to the hinge body and on the other end to the shaft section of the multi-position rib by a rotating slide. The shaft section of the multi-position rib is pivotally connected to the hinge body by the hinge piston. The rotating slide is capable of rotating about an axis through the shaft section and translating along the shaft section. There can be a stop means between the rotating slide and the hinge to limit the movement of the restricter bar toward the hinge.

The hinge piston has a piston housing and a piston bar and is pivotally connected to the hinge body preferably at the piston bar. The piston housing is preferably a part of the shaft section of the rib. There is a hinge push bar connected to the piston bar by a push bar clamp.

The multi position hinge of the present invention is controlled by suitable means, such as a shaft slide in cooperation with latching means to enable the hinge to be latch in a partially or fully opened position.

In accordance with the present invention different sectors of an umbrella can be closed or partially open while other sectors of the umbrella are fully opened. In a preferred application of the present invention where the opposite segments have parallel cords which can be partially closed while sectors between these partially opened segments can remain open result in a trapezoid-like figure. This trapezoid figure can correspond to the front windshield of an automobile. If it is raining, the umbrella can be used in a fully opened position with the partially closed sectors fully opened. The umbrella then has the form of a conventional umbrella.

The capability of opening and closing various sectors around the circumference of the canopy of an umbrella enables umbrellas to be used for a variety of different applications. An application of particular interest is a "stadium umbrella". In this application an umbrella can be divided into at least four sectors. Segments, defined by the outer extension ribs of at least three sectors, can be partially opened with at least one sector that can be fully opened. This will enable the umbrella to have a generally vertical canopy surface behind and on the sides of the user with the front fully opened. With such an umbrella, adjacent fans and the fans behind the user are not interfered with and a person sitting in the stadium would be enclosed within the partially open segments and still have full vision out of the front sector. An umbrella of similar design is also useful in confined areas, such as crowded sidewalks, and on entering or leaving an automobile.

DESCRIPTION OF THE PREFERRED EMBODIMENTS

Figure 1:
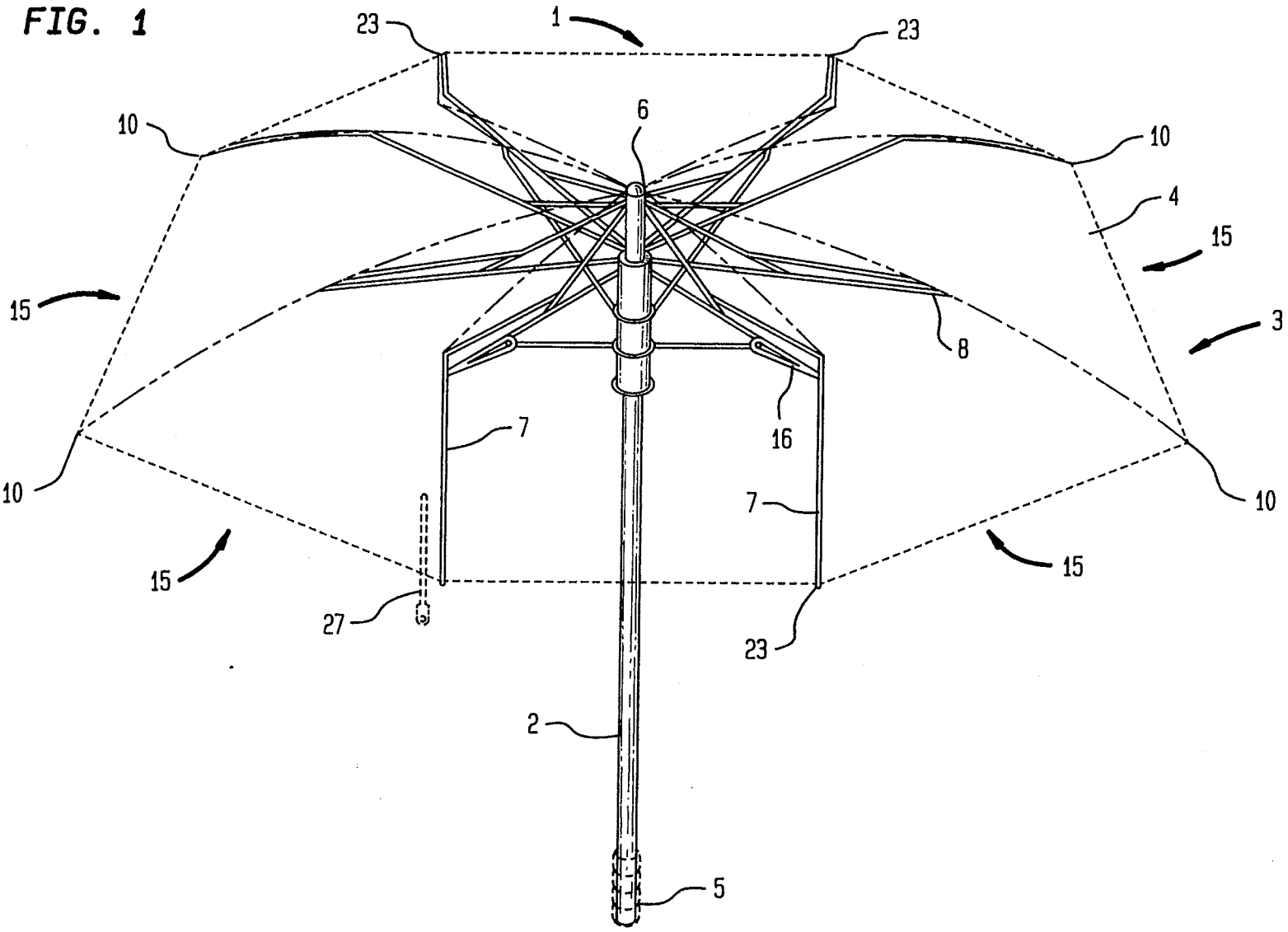
FIG. 1 is a view in perspective of a preferred embodiment of the present invention. The canopy cover is shown in phantom view with extension and hinged ribs illustrated.

A preferred embodiment of the present invention will be understood by those skilled in the art by reference to the embodiments shown in the Figures. FIGS. 1 through 11 illustrate a preferred car sun shade embodiment.

The present invention as illustrated in FIGS. 1–11 is an apparatus which is an umbrella that has a closed position, a middle position and an open position. There is a means to latch the umbrella in the middle position and a means to latch it in a fully open position. The umbrella can be used with a non-collapsible umbrella shaft and unhinged extension ribs, or a collapsible umbrella with hinged extension ribs and a collapsible shaft. In the middle position the umbrella can have a desired canopy shape, preferably in the shape of a quadrilateral, and more preferably a trapezoid. The trapezoid outer canopy surface is slightly convex. The size of the trapezoid is suitable to fit above the dashboard of a truck, automobile, airplane or the like and provide a shade screen. The umbrella with a fully open canopy position takes the form of a conventional umbrella. The fully opened canopy has a periphery or outer perimeter defined by the rib ends. The preferred canopy periphery can be a circle, an oval, or oblong. The extension rib ends correspond to a middle position shape such as the corners of a trapezoid.

An umbrella canopy 3 comprises a rib assembly 1 comprising a plurality of canopy ribs and a canopy cover 4. The canopy ribs comprise at least one multi-position canopy rib 7. The canopy ribs, preferably and optionally, comprise at least one extension rib 8. The umbrella comprises a shaft 2 from which the ribs extend radially. The shaft of the present invention has a handle end 5 and a canopy end 6.

There are means to control the position of the umbrella in a closed position, at least one middle position, and a fully opened position.

Figure 11:
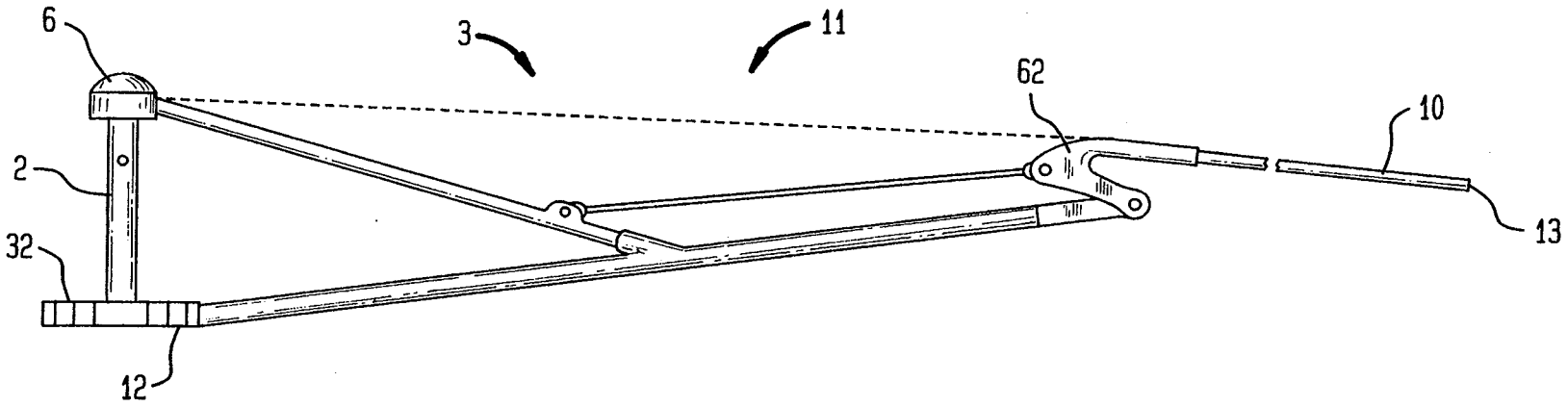
FIG. 11 illustrates a conventional collapsible umbrella rib. This type of rib can be used as an extension rib in the apparatus of the present invention.

The extension rib 8 has an extension rib shaft end 9 pivotally connected to the shaft canopy end 6 and radially extending from shaft 2 to an outer extension rib end 10. In a conventional, non-collapsible umbrella there is no collapsing hinge between extension rib shaft end 9 and outer extension rib end 10 of the extension rib 8. The extension rib 8 is a relatively stiff continuous umbrella rib. Referring to FIG. 11, a conventional, collapsible extension rib 11 is illustrated. This collapsible extension rib 11 contains a conventional collapsible hinge 62. The collapsible extension rib 11 has only two positions which are stably maintained during operation of an umbrella. The first is a fully closed, or collapsed, position and the second is a fully opened or extended position as illustrated in FIG. 11. The collapsible umbrella extension rib 11 has a collapsible extension rib shaft end 12 and a collapsible umbrella extension rib outer end 13. In the collapsed position, the collapsible umbrella extension rib 11 between hinge 62 and end 13 folds toward the shaft handle 5 by downward movement of end 9 along the umbrella shaft. The section of the rib between hinge 12 and end 13 rotates about hinge 62 and extends from hinge 62 toward the shaft canopy end 6. With either the conventional extension rib 8, or the collapsible extension rib 11, there are only two positions at which the canopy 3 is stably latched, a closed position wherein the canopy is collapsed and an open position wherein it is fully extended. Further, the whole canopy opens and closes as one unit.

In the preferred embodiment illustrated in FIGS. 1 through 11, the canopy 3 comprises four extension ribs 8 extending from shaft 2. The portion of the canopy cover 4 between the radially extending extension ribs 8 and the outer perimeter of the canopy is a sector 15. There can be up to eight, and preferably from one to eight, and most preferably from one to six extension ribs 8. In a most preferred embodiment there are four extension ribs 8. Sectors 15 are defined by adjacent extension ribs 8. At least one of the sectors further comprises a multi-position canopy rib 7.

In the embodiment of a stadium umbrella as shown in FIGS. 12 through 15 reviewed below, there is at least one multi-position rib in each of three sectors. In the embodiment wherein the middle position is suitable for a car shade, there is at least one multi-position rib in at least two opposite sectors to permit these sectors to fold in the middle position. By opposite sector it is meant that the sectors are not adjacent but alternate wherein the angles between the extension ribs 8 at the shaft are vertical or opposite angles and the canopy circumference of each sector is not adjacent but opposite.

Figure 2:
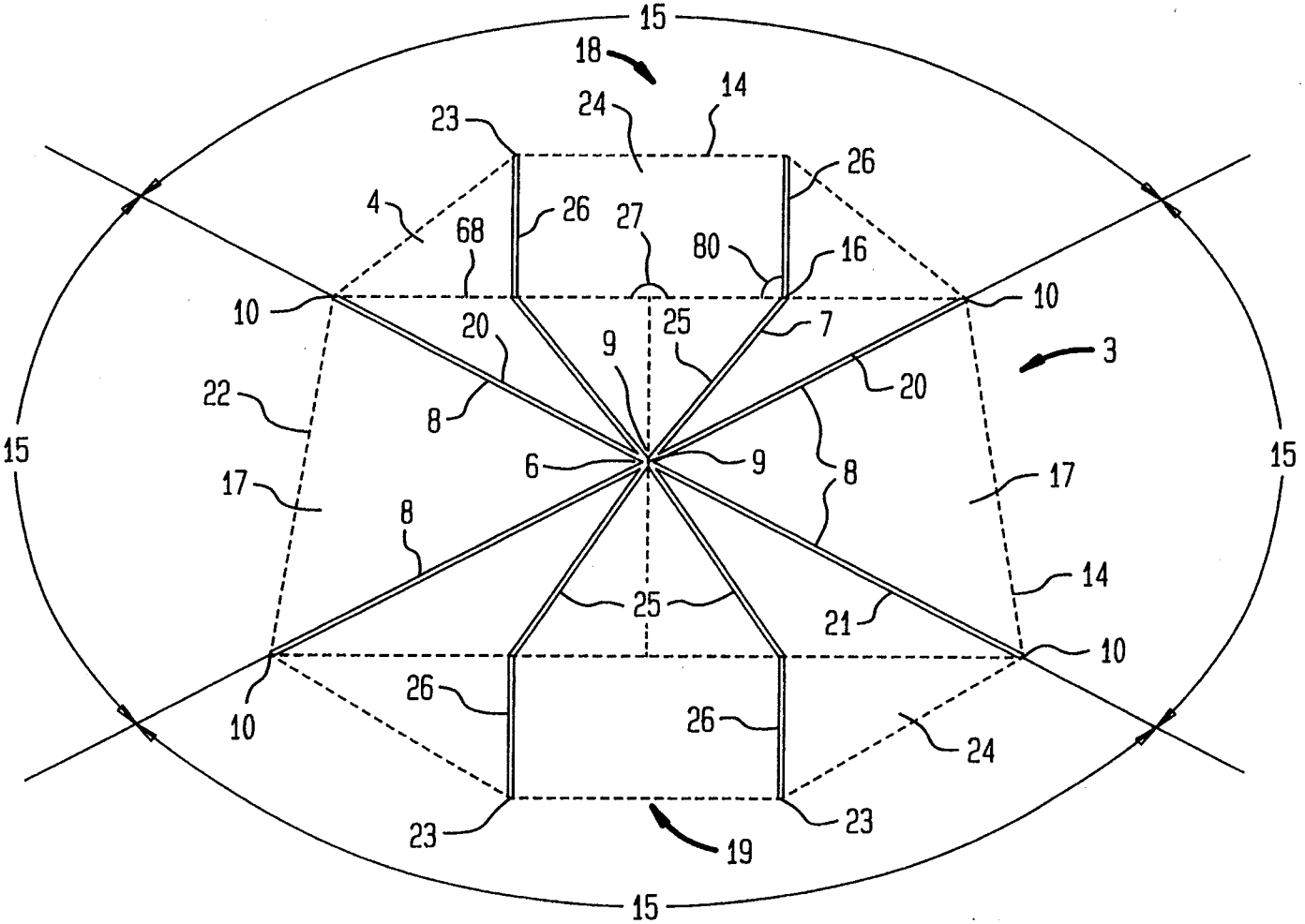
FIG. 2 is a top view of the canopy of the umbrella shown in FIG. 1 in a fully open position.
Figure 3:
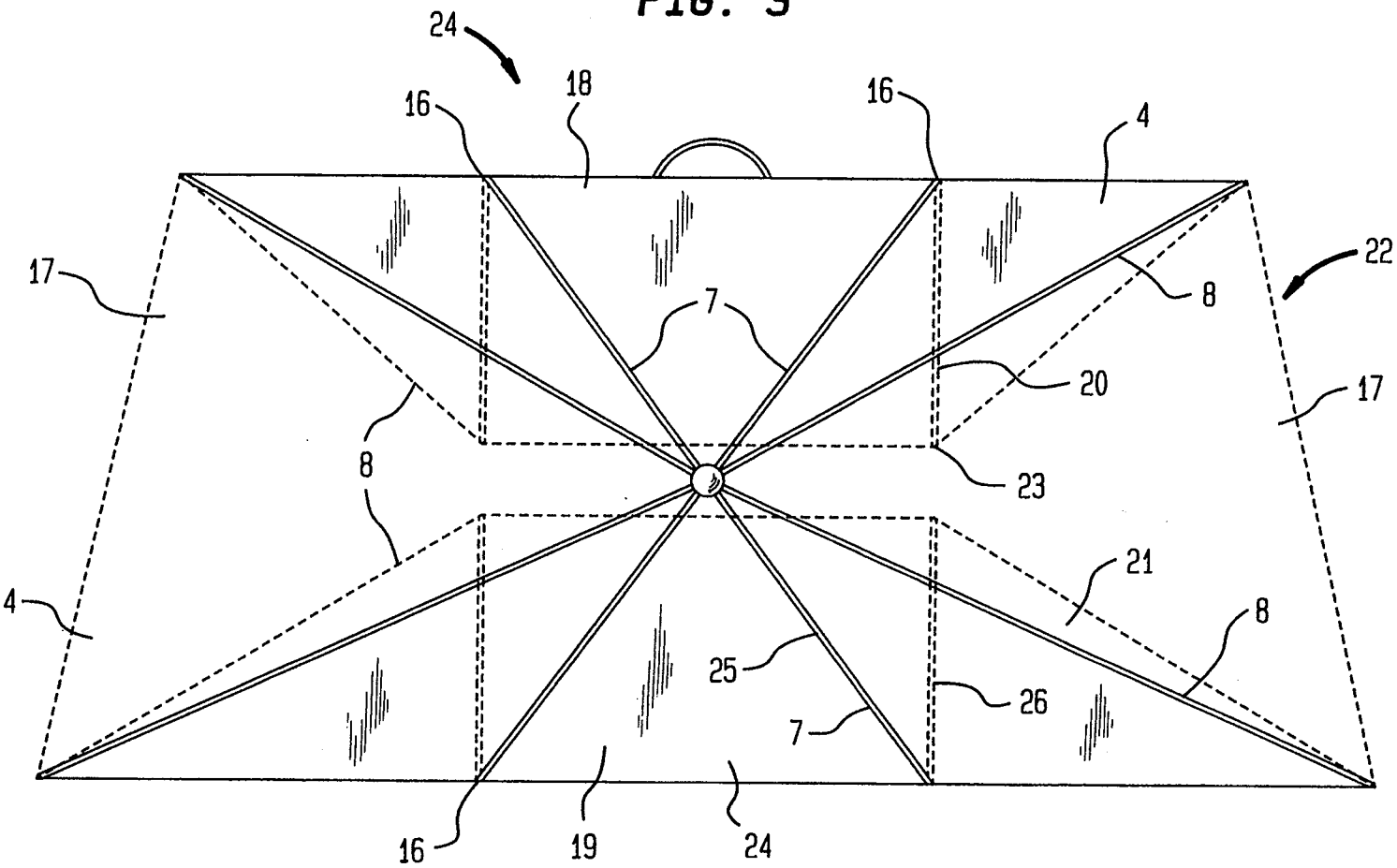
FIG. 3 is a top view of the canopy of the embodiment of FIG. 1 in partially opened position.

The multi-position rib 7 comprises a multi-position hinge 16. In FIG. 2, the multi-position hinges 16 are preferably located along substantially straight lines 68, 69 in the canopy surface extending between outer extension rib ends 10 of extension ribs 8. In the fully open position the end sections 26 of the multi-position ribs extend from the multi-position hinges 16 perpendicular to lines 68, 69 in the canopy surface.

Figure 7:
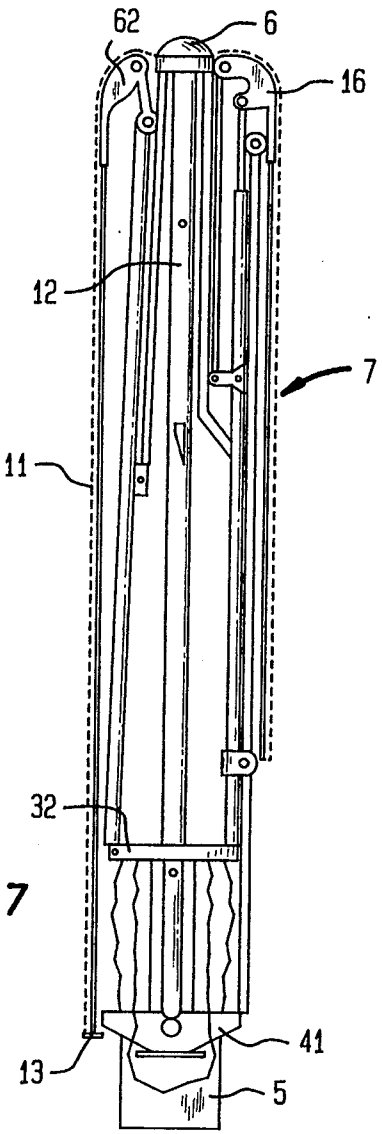
FIG. 7 is a side view of a collapsible umbrella showing the multi-position rib and an extension rib in a fully closed position.

The embodiment illustrated in FIGS. 1 through 10 has three positions. FIG. 7 shows a first position where the canopy 3 is closed. In this position the rib ends 10 and 23 are at their closest distance to the shaft 2. In the at least one middle position shown in FIGS. 3 and 5 the extension ribs 8 are fully extended, fully opening the shade sectors 17. The sectors 18 and 19 containing the multi-position ribs extend partially, resulting in the segments 24 being closed or partially open to form the shape of the middle position. For a trapezoid shape there are two folding sectors, a short sector 18 and a long sector 19. The short sector 18 is bounded by two short extension ribs 20 which are preferably of equal length. The long sector 19 is bounded by long extension ribs 21 which are of equal length and longer than the short extension ribs. The line 68 between the outer extension rib ends 13 of the short extension ribs 20 and the line 69 between the outer extension rib ends 13 of the longer extension ribs 21 are parallel to each other. This results in a trapezoid formed by the lines between the extension rib ends 10. The length of the extension ribs 8 (20 and 21) can be varied so that the trapezoid can easily fit into an automobile, truck or airplane window.

Figure 5:
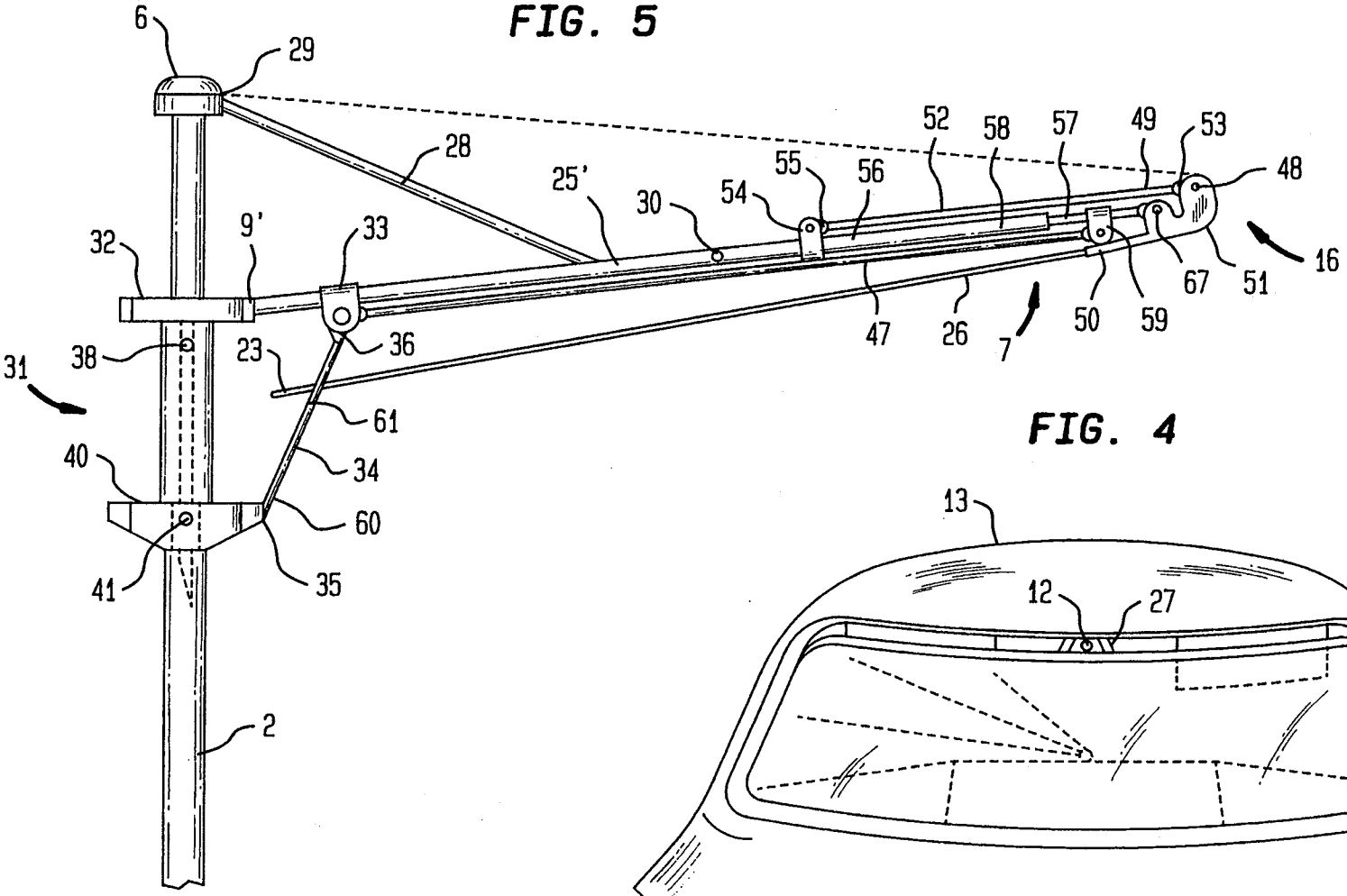
FIG. 5 is side view of the canopy end of the shaft showing a multi-position rib in a partially open position.

The canopy 3 is connected to the shaft 2 at the shaft canopy end 6. The canopy when fully opened extends radially from the shaft canopy end 6 to the outer rib ends 10 of the extension ribs 8 and the outer end 23 of the multi-position ribs. The portion or area of the canopy 3 between the canopy perimeter 14 and the line 68 or 69, between adjacent extension rib ends 10 containing at least one multi-position rib is a segment 24. When the umbrella is in the closed position all of the outer rib ends 10 and 23 are collapsed toward the shaft. When the umbrella is in a middle position the extent to which the umbrella is opened is controlled and at least one middle position the umbrella is latched into place. In the middle position the multi-position hinges 16 can be in position from closed up to but less than fully opened and are preferably in a closed position as shown in FIG. 5. In the middle position, when the multi-position hinge 16 is fully closed, as in the embodiment in FIG. 5, the segment 24 of the canopy cover 4 is folded back toward the shaft 2. In this way, a trapezoidal-type or other functional shape is formed.

Figure 4:
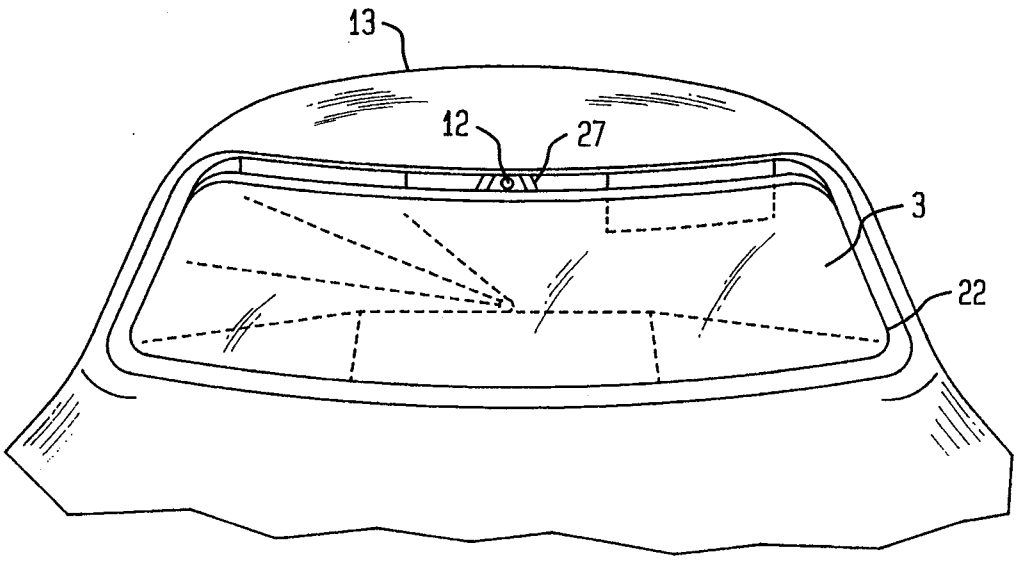
FIG. 4 is a view in perspective of an automobile showing the umbrella of the present invention in a middle position used as a car sun shade.

When the apparatus is used as a car shade, there is a means such as fastenable strap 27 to fasten the canopy when opened in the middle position, preferably in the shape of a trapezoid, to the inside windshield 12 of an automobile 13 as generally shown in FIG. 4. The umbrella shaft can be pressed against the front seat of an automobile.

Referring to FIG. 5, a preferred multi-position canopy rib 7 comprises a shaft section 25 between the shaft 2 and the multi-position hinge 16. The multi-position canopy rib 7 also has an outer section 26 between the multi-position hinge 16 and the outer rib end 23. The multi-position hinge 16 comprises a means, such as a pivot, to bend the outer section 26 at an angle to the shaft section 25 of rib 7. Preferably, the multi-position rib hinge 16 also has a means to rotate axially to the shaft section 25 of the rib 7.

FIGS. 5–10 disclose a preferred actuating means for moving the canopy between the open, middle and closed positions. There is a rib control strut 28 pivotally connected to the shaft canopy end 6 of shaft 2 at a strut shaft end 29. The rib control strut 28 has a strut rib end 30 pivotally connected to each extension rib 8 and multi-position canopy rib 7. The shaft 2 is shown as a collapsible shaft 2 with shaft extension 46 telescoping into shaft 2.

Shaft slide 31 has a shaft slide top 32 facing the shaft canopy end 6 and a shaft slide bottom 40 facing the handle end 5. The shaft slide 31 is disposed to slide axially along the shaft 2. All the ribs are connected to shaft slide top 32 for the present invention used in a collapsible umbrella. The extension ribs 8 are connected to the shaft slide top 32 at extension rib shaft ends 9 and the multi-position ribs are similarly connected to shaft slide top at multi-position rib shaft ends 9'. Reference is made to FIG. 11 for a typical configuration for a conventional collapsible extension rib 11.

A push bar strut 34 is pivotally connected to the shaft slide bottom 40 at a strut shaft slide end 35. Push bar slide 33 is disposed to slide along the shaft section 25 of multi-position rib 7. The push bar strut 34 is pivotally connected to the push bar slide 33 at a strut rib slide end 36. Preferably, the push bar strut 34 has means to axially extend which can preferably be a piston as illustrated in FIGS. 10, A, B and C. In FIG. 10A the piston is fully extended when the umbrella is closed. In FIG. 10B the piston is fully closed when the umbrella is open and similarly when the umbrella is in the middle position. The shaft slide 31 has a shaft slide bottom 40 which can be used to control the position of the multi-position ribs. Handle 42 is at the shaft handle end 5. Handle 42 contains a shaft extension 46 unlocking means and a shaft slide bottom 40 unlocking means such as unlocking button 43 to permit the umbrella to be move from the closed position to the fully opened, "rain" position. Slide bottom 40 can move independently of slide top 32. The slide bottom 40 substantially controls the multi-position rib hinge 16 through strut 34.

Figure 9A:
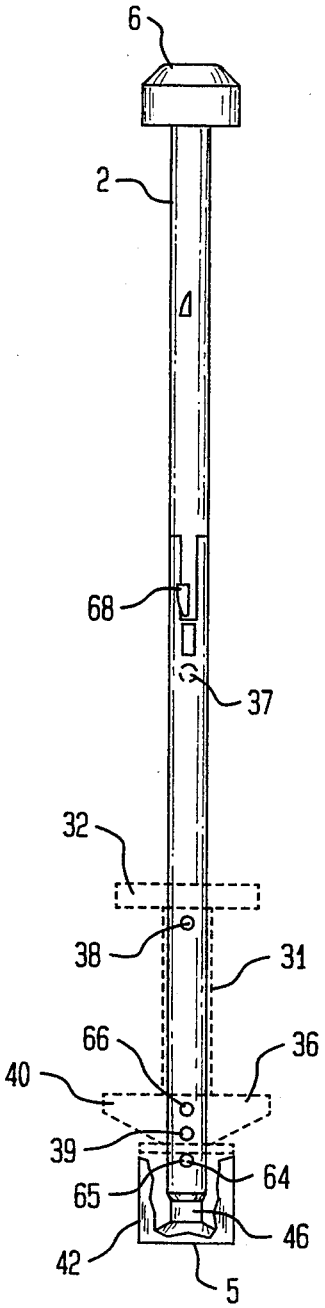
FIGS. 9A, 9B and 9C illustrate a shaft and slide assembly showing the slide assembly along the shaft of a collapsible umbrella in a fully closed, middle, and fully opened position respectively.
Figure 9B:
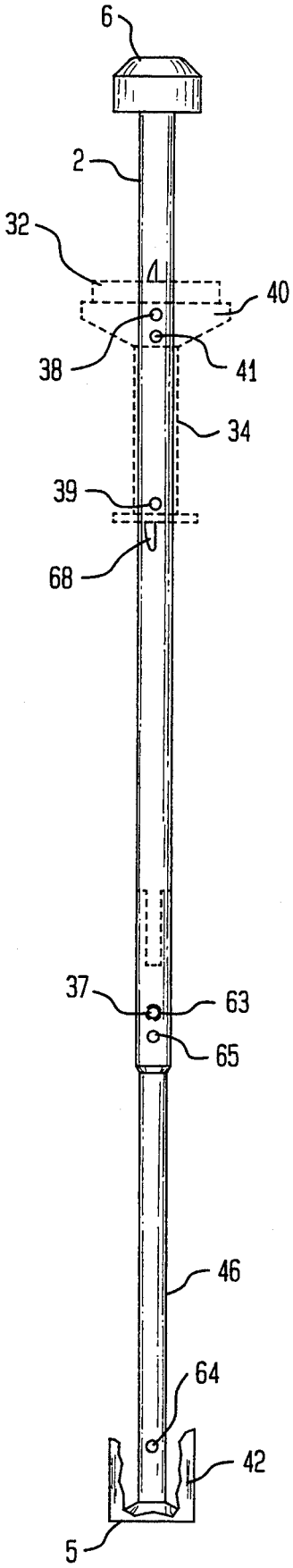
Figure 9C:
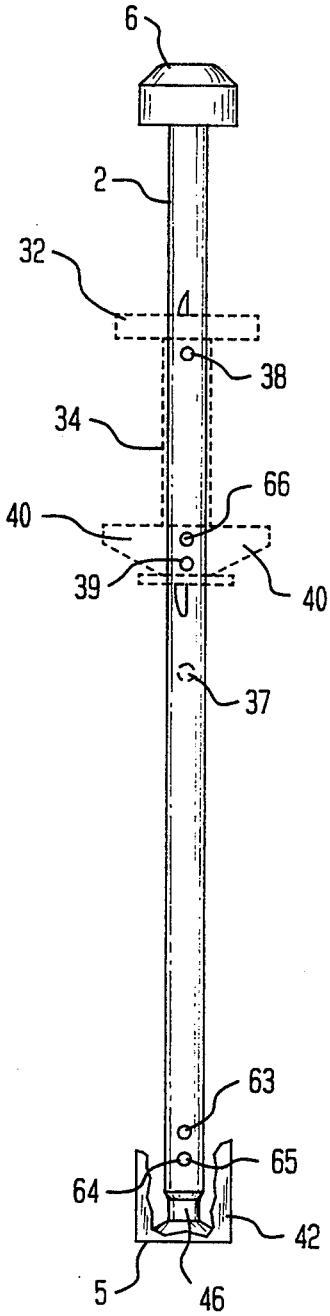

Any suitable latch means can be used. Referring to FIG. 9, the shaft slide 31 is shown in different positions along the shaft 2 of a collapsible umbrella. In FIG. 9A the slide 31 is at the bottom of the shaft 2, and the shaft slide bottom 40 is at the bottom of the shaft slide when the umbrella is collapsed. In FIG. 9B the slide 31 is toward the top of the shaft 2 secured by spring latch 68 when the umbrella is in the fully opened position. The shaft slide bottom 40 is at the top at shaft slide 31, secured by latch button 38. In FIG. 9C the slide top 32 position on the shaft 2 is the same as in FIG. 9B, however, the shaft extension 46 is collapsed into shaft 2 and the shaft slide bottom 40 is at the lower end of the slide 31. There is a button latch 39 on the shaft slide 31 to secure the multi-position ribs in the middle or closed positions. This secures the slide bottom at the bottom of slide 31.

Figure 8:
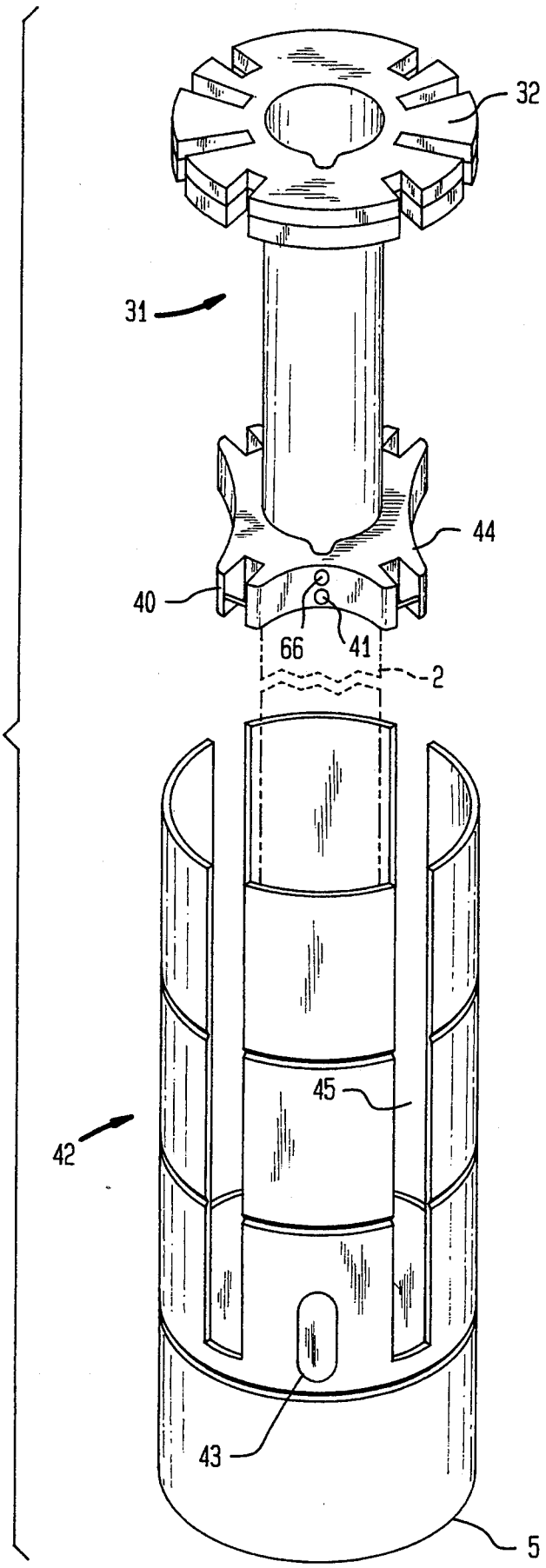
FIG. 8 is an exploded view of a preferred slide assembly useful in the present invention.

A useful latch means include spring-loaded buttons and corresponding latch holes. The buttons are preferably in shaft 2, with corresponding holes in slide 31. Button latch 39 comprises a spring loaded button in shaft 2 and a hole in slide bottom 40. When the umbrella is in a closed position (FIG. 9A), the shaft slide 31 registers at the handle 42. This is shown in FIG. 8 by the shaft slide bottom 40 having four extensions 44 which slide into handle extension slots 45. The shaft slide button 39 interacts with handle unlocking button 43. Upon pressing button 43, the button 39 is disengaged from hole 41 and the shaft slide bottom 40 can be pushed to the top of slide 31 where hole 66 is latched by button 38. With the same motion continuing, slide 31 can be pushed along main shaft portion 2 and is latched at slide latch 68 which is a spring loaded extension from shaft 2. Where the umbrella is a collapsible umbrella the handle button 43 can release a shaft extension 46 by depressing shaft extension button 64 which can extend and then engage a shaft extension latching means and interlock such as button 37 in hole 63, to form a longer shaft. The shaft extension 46 telescopes out of the main shaft portion 2. The canopy is latched fully open by button 38 latching in hole 66 as shown in FIG. 10B.

Figure 10C:
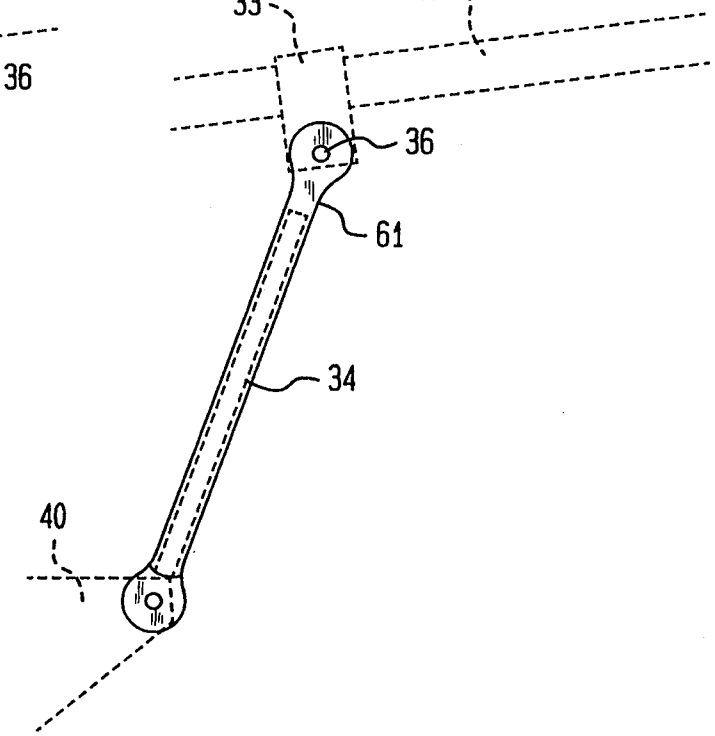
FIGS. 10A, 10B and 10C illustrate the strut in a closed position, middle position and open position respectively.
Figure 10B:
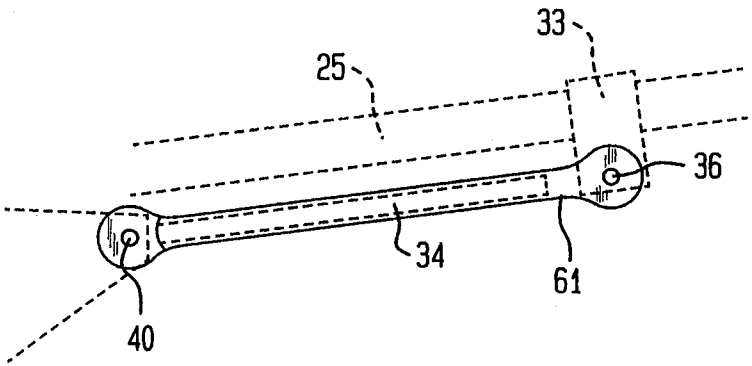
Figure 10A:
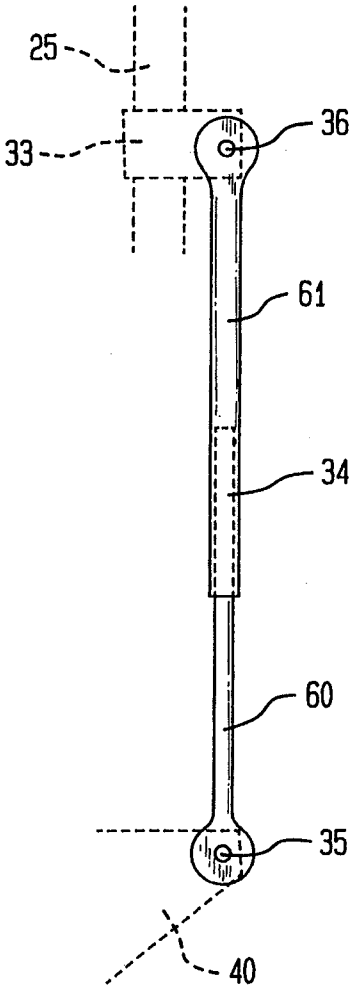

In the middle position, FIG. 10C the shaft extension 46 is latched into shaft 2 by button 64 in latch hole 65. The slide 31 is latched at spring latch 68. Shaft slide bottom 40 is latched at the bottom of slide 31 by latch bottom 39 in hole 41. This secures the multi-position hinge 16 in a closed or partially open position.

A push bar 47 is connected to push bar slide 33 on one end and on the other end to the push bar clamp 59 which is fastened to hinge piston bar 57. The push bar 47 is of sufficient length to open the multi-position hinge 16 by moving the hinge piston bar 57 outward and thus fully extending the multi-position rib 7 in the rain position. The reverse action closes the hinge and the rib end section 26. When the shaft slide bottom 40 is latched at the lower end of the shaft slide 31, the multi-position hinge 16 is closed or only partially opened. When the shaft slide bottom 40 is latched against the shaft slide top 32, the hinge 16 is opened.

The position of the shaft slide 31 on the shaft 2 determines the position of the extension ribs 8 and the position at the shaft section at the multi-position rib 25. When the slide 31 is latched at the handle end 5, the extension ribs 8 and the multi-position rib shaft ends 25 are closed. When the slide 31 is latched at the upper end near the shaft canopy end 6, the extension ribs 8 and the shaft ends of the multi-position ribs 25 are open. As recited above, the position of the shaft slide bottom 40 determines the extent the multi-position hinge is opened.

Preferably, the multi-position rib hinge comprises a means to rotate the multi-position hinge 16 about an axis perpendicular to the shaft section 25 of the multi-position hinge 7. Additionally, there is a means to rotate the hinge 16 tangentially around the axis of the shaft section 25. The canopy extends from the shaft 2 to the end 23 of the multi-position rib. When the hinge moves from the fully closed to fully opened position the ability to rotate, along with the hinge piston bar movement helps to compensate for changes in the radial dimensions of the canopy cover 4 and prevents tearing and/or looseness in the cover.

Figure 6:
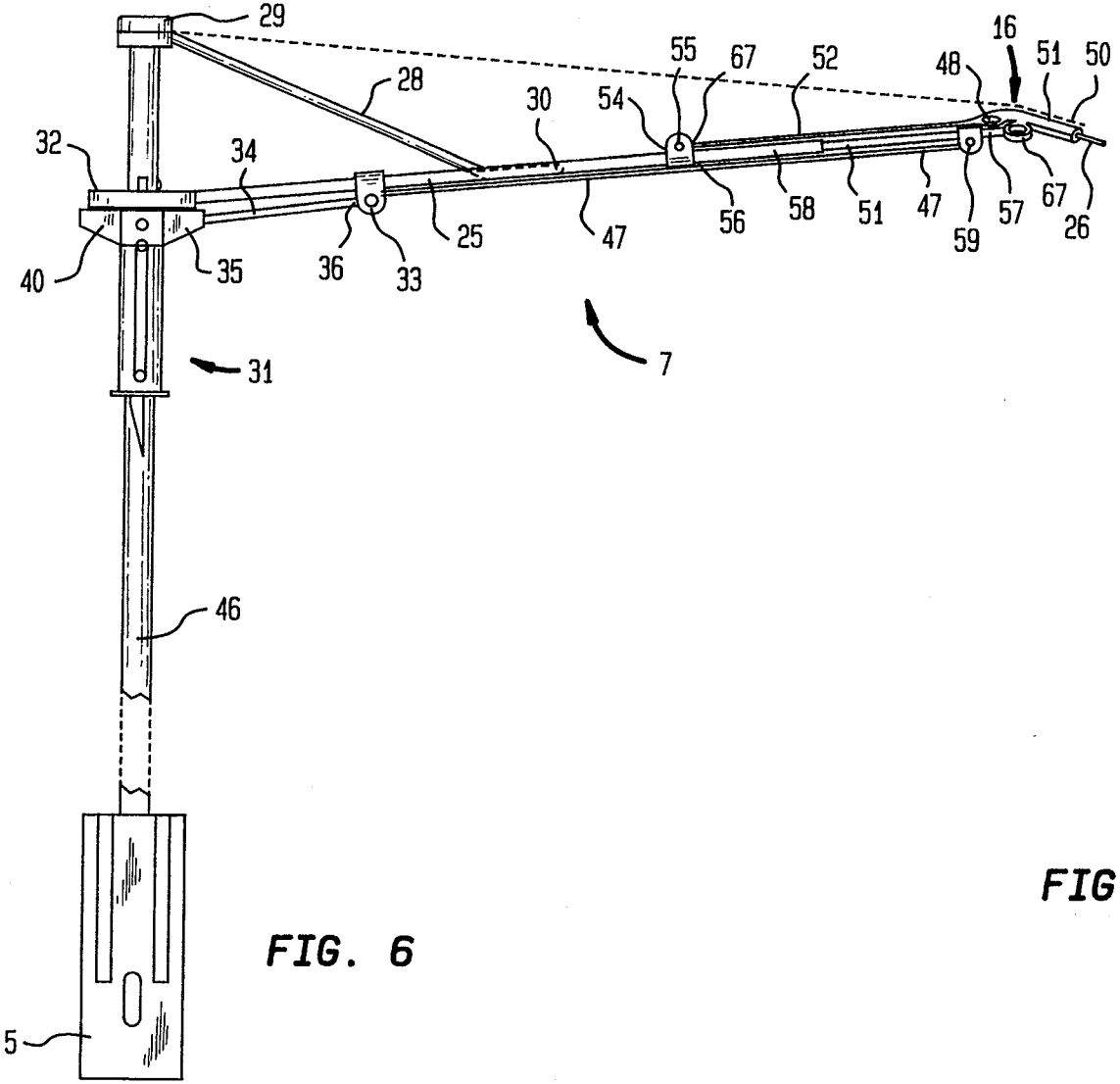
FIG. 6 is a view of the canopy end of the shaft showing the multi-position rib in a fully opened position.

The multi-position hinge 16 can have any suitable construction with a preferred construction illustrated in FIGS. 5 and 6. In FIG. 5 the hinge is shown closed with the umbrella in a middle position and in FIG. 6 the hinge is shown open in a completely open position. The hinge can be latched in any position. Depending on the location of suitable latch means, the hinge can be latched in any position intermediate between the fully closed position shown in FIG. 5 and the fully open position shown in FIG. 6. For example, reference is made to the embodiments illustrated in FIGS. 12 through 15 where the hinge is opened halfway or through a 90° rotation to enable the segment to be in a plane parallel to the shaft.

The preferred multi-position hinge 16 illustrated in FIGS. 5 and 6 comprises hinge pivots 48 and 67 which enable the hinge to pivot at an angle to shaft 2. Hinge shaft section 49 is between shaft 2 and the hinge pivot 48. There is a hinge end section 50 located between the hinge pivot 48 and the outer rib end 23. There is a means to rotate the multi-position rib hinge 16 axially to the shaft section 25 of the multi-position rib 7.

Preferably, the hinge end section 50 rotates axially about shaft section 25 of the multi-position rib. This construction permits the end sections of the multi-position ribs 26 to extend at an angle to their radially-extended shaft sections in the fully open position, and parallel to each other, and therefore perpendicular to the parallel sides of the trapezoid, as illustrated by angle 80 in FIG. 2. This construction permits the folding of the segments with the remainder of the canopy opened.

The canopy cover 4 of the umbrella can be connected to the shaft 2, typically at the shaft canopy end 6. The canopy extends radially from the shaft 2 and is attached to the outer rib ends 10 of extension ribs 8 and outer extension rib ends 23 of multi-position ribs 7. The rotation about pivot 48 enables the multi-position rib to remain closed or partially opened. When extension ribs 8 are fully extended, compensation must be made for changes in the canopy stretch distance from the shaft canopy end to the tips of the outer ends 13 of the multi-position ribs. The distance caused by the closing of the multi-position ribs is compensated by the contraction of the hinge piston bar 57 into the hinge piston bar housing 57. This allows the canopy fabric to remain taut in the radial direction when the umbrella is in a middle position.

In a preferred embodiment the multi-position rib hinge 16 comprises a hinge body 51. Restricter bar 52 is connected at a restricter bar hinge end 53 to the hinge body 51 at radial hinge pivot 48. The restricter bar 52 is connected to the shaft section 25 of the multi-position rib 7 through a rotating slide 54. The rotating slide 54 is slidably connected to shaft section 25. The restricter bar is connected to the rotating slide 54 at restricter bar slide end 55. The rotating slide 54 is able to axially rotate about multi-position rib shaft end 25. The rotating slide 54 and related assembly result in an axial pivot means to enable the end section 26 to rotate axially to shaft section 25. As the end section 25 axially rotates the multi-position hinge 16 and the end section 26 of the multi-position rib 7 also rotate axially.

The rotating slide 54 can slide axially along the shaft section 25 of the multi-position rib. In this way, as the hinge 16 rotates about hinge pivot 48 the rotating slide 54 can move along shaft 25. Preferably there is a rotating slide stop means 56 between the rotating slide 54 and the hinge 16 to limit movement of the restricter bar 52 toward the hinge 16.

The hinge 16 further comprises a hinge piston bar 57 connected to the hinge body 51 at hinge pivot 67 at one end of the piston bar 57. The opposite end of the piston bar is enclosed in the shaft section 25 of the multi-position rib 7 through a hinge piston bar housing 58. The hinge piston bar housing 58 is coaxial to the shaft section 25 of the multi-position rib. The piston bar 57 is free to rotate within the piston bar housing 58 and also within push bar clamp 59.

The hinge push bar 47 is interconnected between the push bar slide 33 and push bar clamp 59. The push bar 47 is pivotally to the push bar clamp 59 which is attached to the piston bar 57 so that the piston bar is free to rotate axially within the clamp 59. The push bar slide 59 is capable of moving the piston bar 57 which opens or closes hinge 16. There can further be a push bar 34 which can have an axial extension means. The push bar 34 can be a piston having strut piston rod 60 and strut piston housing 61 into which the strut piston rod slides. This is particularly illustrated in FIGS. 10A, B and C.

In the stadium embodiment shown in FIGS. 12–15, in the middle position, the multi-position hinge 116 is partially open so that the segment of the multi-position rib between the hinge and the outer extension rib end 13 in a plane is parallel to shaft 102. In this way, the segments 24 can form a wall about the user.

Figure 12:
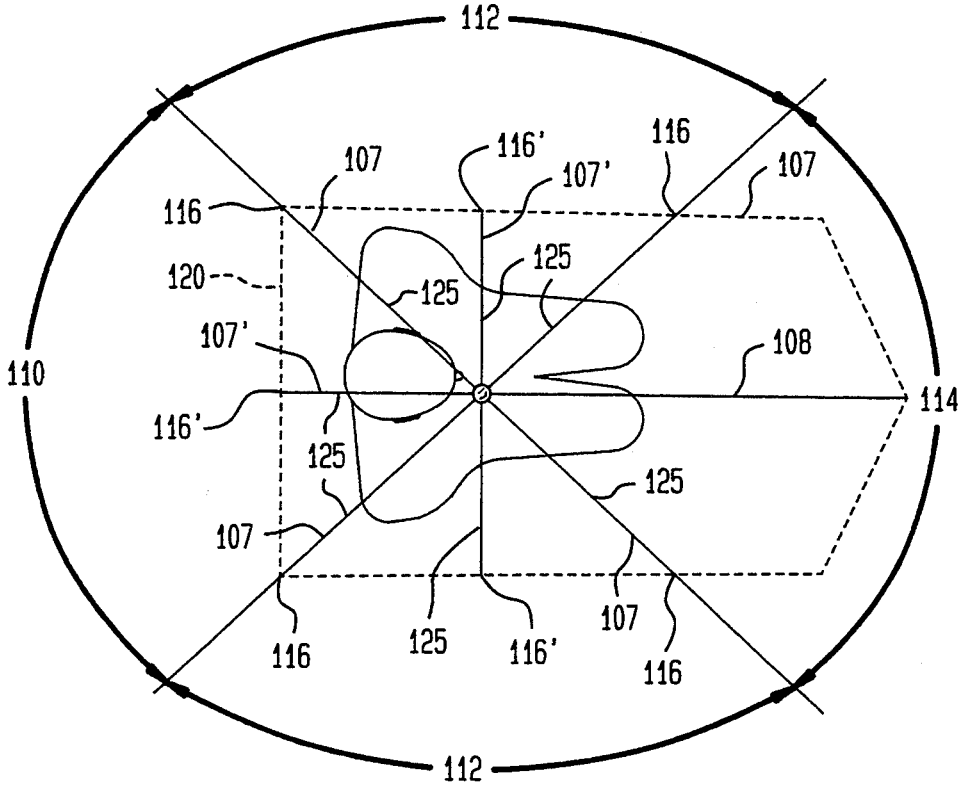
FIGS. 12 and 13 illustrate the top and side view of an alternate embodiment of the present invention in open in the middle position.
Figure 13:
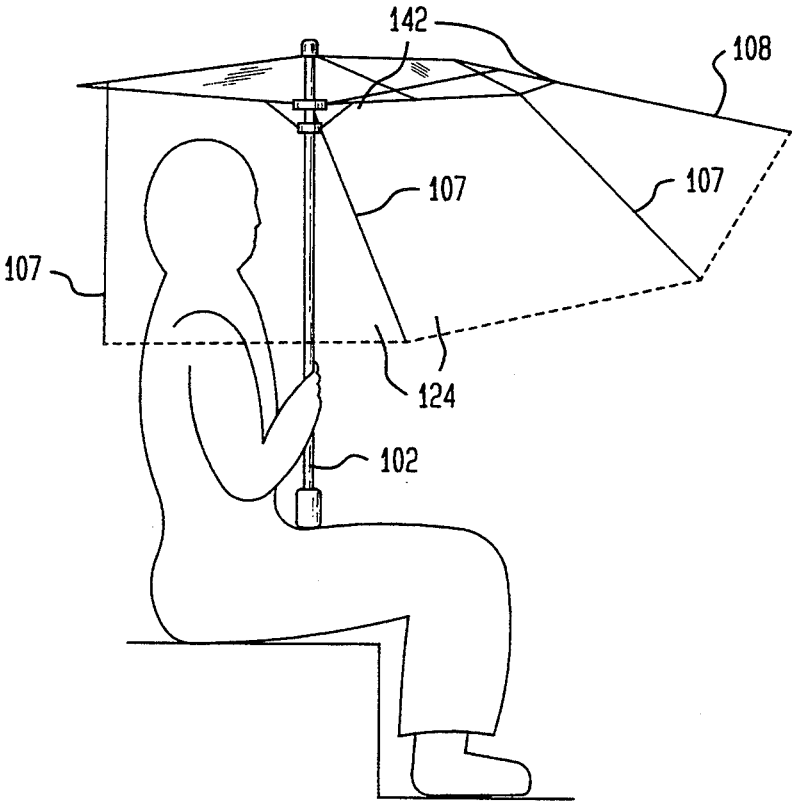
Figure 14:
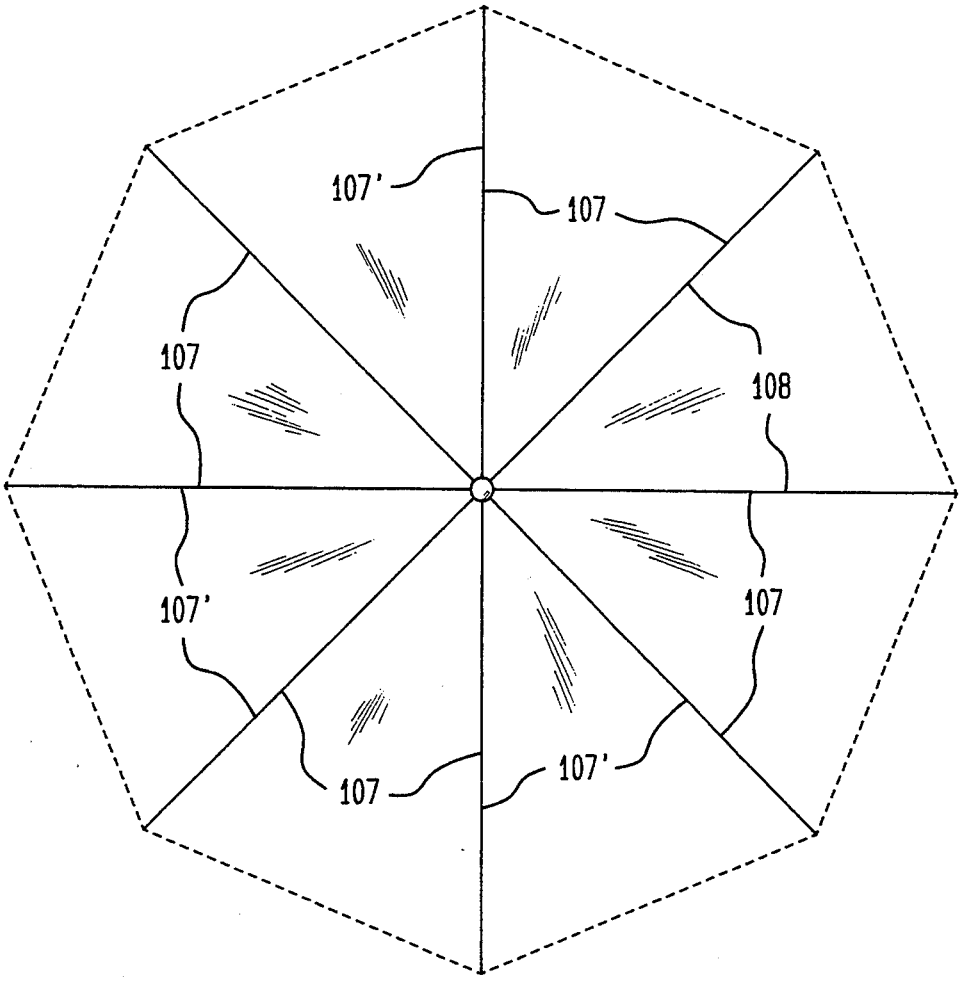
FIGS. 14 and 15 illustrate the embodiments shown in FIGS. 12 and 13 in a fully open position.
Figure 15:
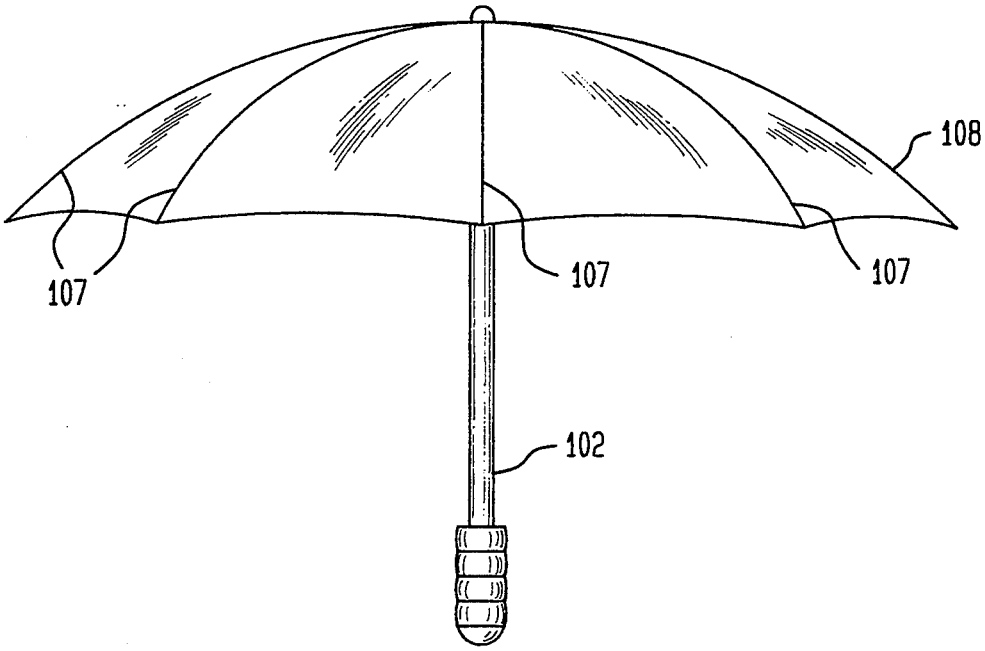

In the stadium embodiment there are preferably seven multi-position canopy ribs 107 and one extension rib 108. The ribs are spaced evenly about the shaft. A stadium sector is defined by two adjacent multi-position ribs. There is a rear sector 110 defined by two of the multi-position ribs 107. Adjacent to the rear sector are two side sectors 112 defined by multi-position ribs 107, preferably 90° apart and each including a multi-hinge rib 107 of the rear sector 110 and a second multi-hinge rib 107. Each of the side sectors and rear sectors contains a multi-position rib 107' spaced evenly between the multi-position ribs 107 defining the sector. The multi-position ribs 107 and 107' hinge each contain a multi-position hinge 116 and 116' respectively. The multi-position ribs 107 and 107' each contain a shaft section 125 and 125' respectively. The multi-position hinge on ribs 107' is located on lines 120 connecting the multi-position rib hinges 116 of multi-position ribs 107. These lines form preferably a square when viewed from the top (FIG. 12). Each of the shaft sections of multi-position ribs 107 are preferably the same length. Each of the shaft sections of the multi-position ribs 107' are also of the same length but smaller than at 107. In the middle position the sectors 110 and 112 are partially open and their outer segments parallel to shaft 102. The front sector 114 contains extension rib 108 fully extended between front multi-extension ribs 107 of the side sectors 112. Thus, in the stadium umbrella's middle position the rear sectors and side sectors are partially open with their outer segments preferably parallel to the shaft, and the front sector 114 is fully open permitting the user to have a view out of the front of the umbrella. FIGS. 14 and 15 are the embodiment of FIGS. 12 and 13 in a fully opened position.

The apparatus of the present invention can result in any number of different applications for an umbrella wherein different segments can be closed or partially opened. Two preferred apparatus are illustrated in the Figures. References is made to the embodiment illustrated in FIGS. 1–10 illustrating an umbrella having a middle position wherein the segments are closed and the middle position can be used as a sun airplanes and the like. In this embodiment there can be suitable means to fasten the umbrella in place inside the windshield of the automobile. A preferred method is to fasten the canopy to the rear view mirror assembly of an automobile by strap 27 as illustrated in FIG. 4. The strap 27 can be attached at one end or both ends to the canopy to allow it to be snapped around a portion of the mirror. Alternatively, the automobile apparatus can be secured in place by pressing the shaft 2 against the front seat of the automobile with the canopy portion located against the windshield, or seated in place by lowering the vehicle's sun visors. The apparatus of FIGS. 12–15 is useful as a stadium umbrella with three adjacent sectors, 2 sides and the rear partially open while the front is fully opened.

In considering the various embodiments of the present invention, a specific and preferred embodiment is an umbrella wherein the canopy has at least one position in which the ribs are partially extended. The umbrella comprises a shaft having a canopy end and a handle end. The canopy extends from the canopy end of the shaft generally having a canopy upper or overhead surface extending generally radially from the canopy end. There is at least one wall extending at an angle from the radial canopy surface. These walls can be sidewalls extending preferably parallel to the shaft from the upper canopy to the shaft handle. There can be two opposite sidewalls and a rear wall. Preferably and optionally, there can be a front wall having a viewing port which can be completely opened or made of clear plastic through which the user can see. The umbrella in this configuration is useful for walking in crowded spaces or being used in a crowded area such as a stadium. The upper surface and sidewalls form an a stadium. The upper surface and sidewalls form an enclosing compartment for the user. Alternatively, the front can be fully extended as shown in FIGS. 14 and 15.

Figure 18:
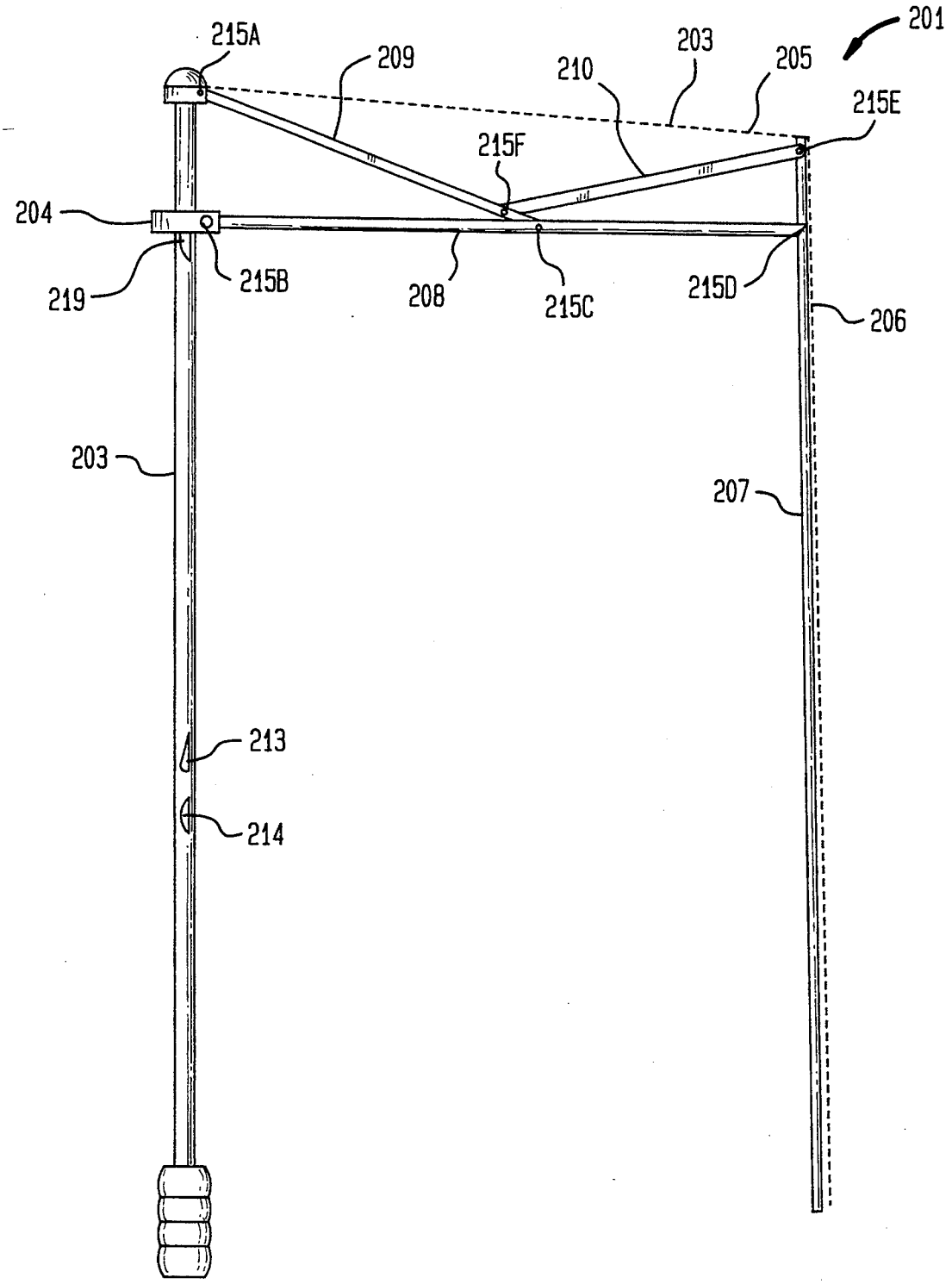
FIG. 18 is a view of the shaft and rib configuration of the embodiment of a long rib in the embodiment of FIG. 16.
Figure 19:
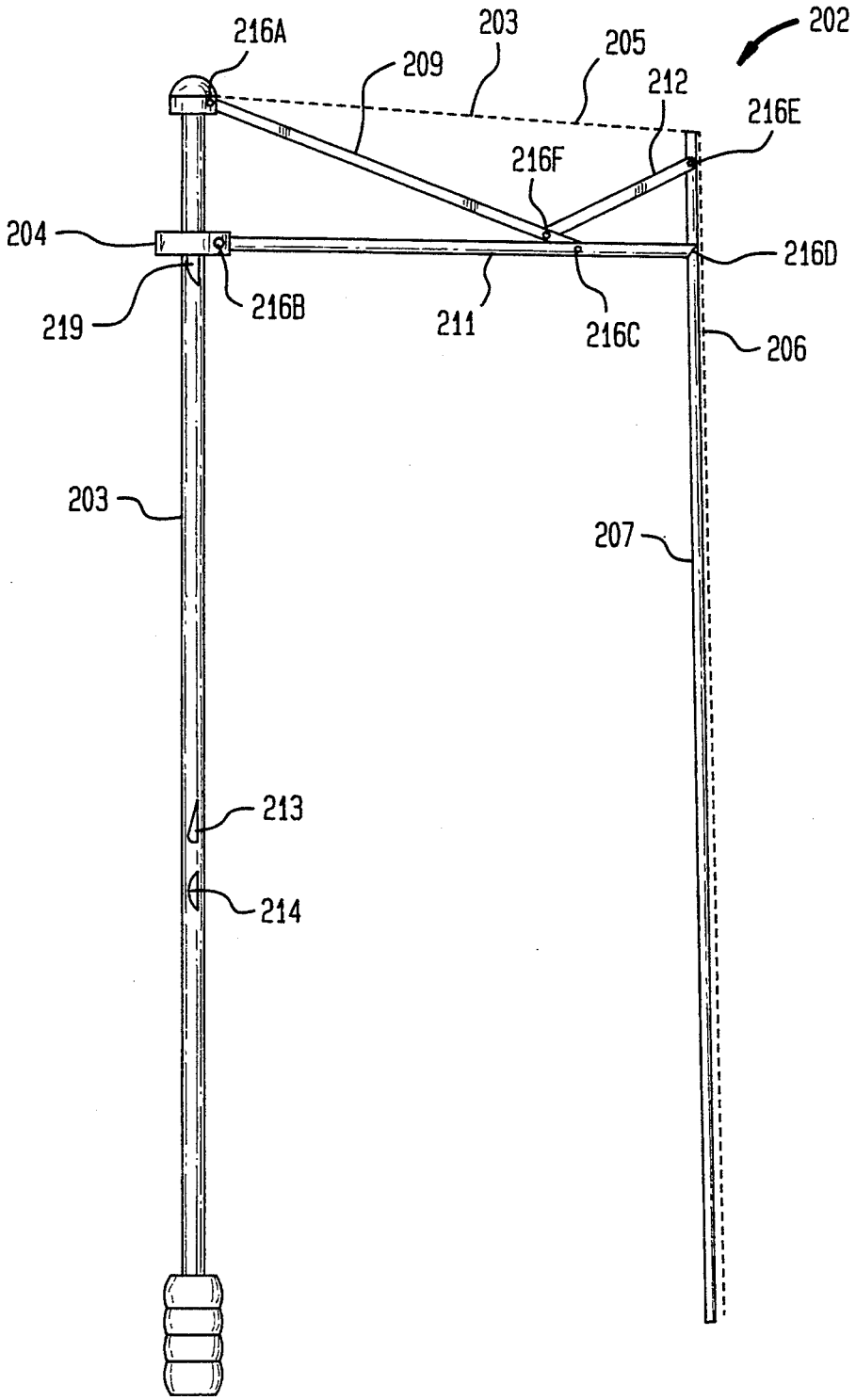
FIG. 19 is a shaft and rib configuration for a short rib in the embodiment of FIG. 16.

An alternate embodiment of the present invention is illustrated in FIGS. 16 through 20. The rib assembly comprises a long rib and strut assembly 201 shown in FIG. 18 and a short rib and strut assembly 202 shown in FIG. 19. The short and long ribs are connected to the shaft end of shaft 203 and to a shaft slide 204. The canopy comprises a canopy upper surface 205 and a canopy wall surface 206. Referring to FIG. 18, the long rib assembly comprises a wall rib section 207 and a long overhead rib section 208. There is a shaft strut 209 pivotally connected between the canopy end of the shaft 203 at **215*a* and an intermediate point of the overhead section 209 at 215*c*. The wall rib is pivotally connected to the overhead rib 208 at hinge 215*d*. There is an overhead rib strut 210 pivotally connected to rib strut 209 and to the end of wall rib 207 and hinge 215*e***.

There is a similar construction for the short ribs with short overhead section 211 connected between shaft slide 204 and wall rib 206 at hinge **216*d*. There is a hinge 209 and 212 which correspond to hinges 209 and 210 of the long overhead rib assembly 201 as recited above. The canopy fabric 203 is draped over the rib assemblies being attached to the canopy end of handle 203 at one end and to the ends of the short ribs and long ribs. Slide 204 is disposed to slide on shaft 203. In the open position, the slide is secured in place by latch 219. In the closed position, the slide 204 is secured in position at latch 213 which is released by latch button 214**.

Figure 20:
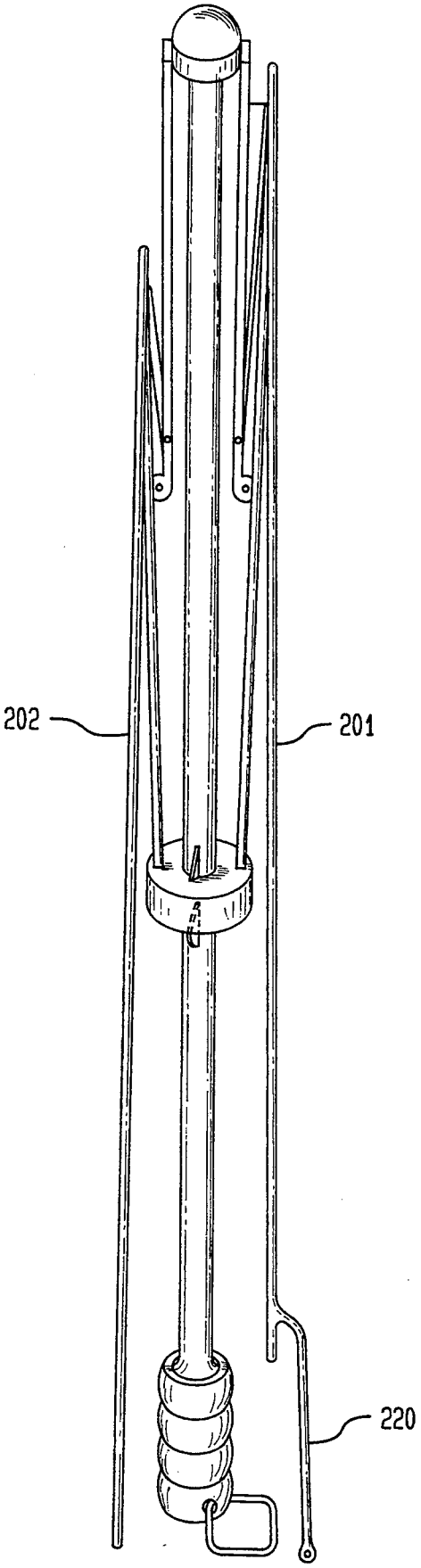
FIG. 20 is a view of the short and long rib of the embodiment of FIG. 16 in the fully closed position.

FIG. 20 shows the umbrella in a fully closed position with strap 220 useful to secure the canopy at the handle end of shaft 203.

This particular embodiment partially opens to the restricted sidewall position. It is useful in crowded or confined areas, such as stadiums or heavily trafficked sidewalks. The hinge structure permits the umbrella to be closed into a convenient folded position.

This embodiment can be combined with conventional umbrellas wherein the ribs can have further collapsing hinges or have no additional collapsing hinges. If the shaft is non-collapsing the ribs are a single unit hinged at the top of the shaft and are of a length approximately equal to the shaft. The rib and control support is provided by the struts hinged to the ribs at one end and to the shaft slide at the other as recited. Lowering the shaft slide 204 allows the ribs, which are hinged to the top of the shaft, to fold against the shaft.

If the shaft is collapsible, the ribs of a conventional umbrella are constructed in two sections hinged to each to permit the sections to fold against each other, as well as to the shaft. Such collapsible hinges are known and shown in FIG. 11. Each section of the rib is longer than the length of the collapsible shaft. The shaft section of the two piece rib is connected by hinge to a shaft slide whose movement along the shaft opens or closes the canopy.

In this embodiment, as shown in FIGS. 16–20, there is a non-collapsing shaft and double section foldable ribs. Like the ribs of a conventional collapsing umbrella, they have two hinge sections and two struts. Unlike the conventional collapsible umbrella, the outer rib sections are substantially vertical when the umbrella is open.

Figure 16:
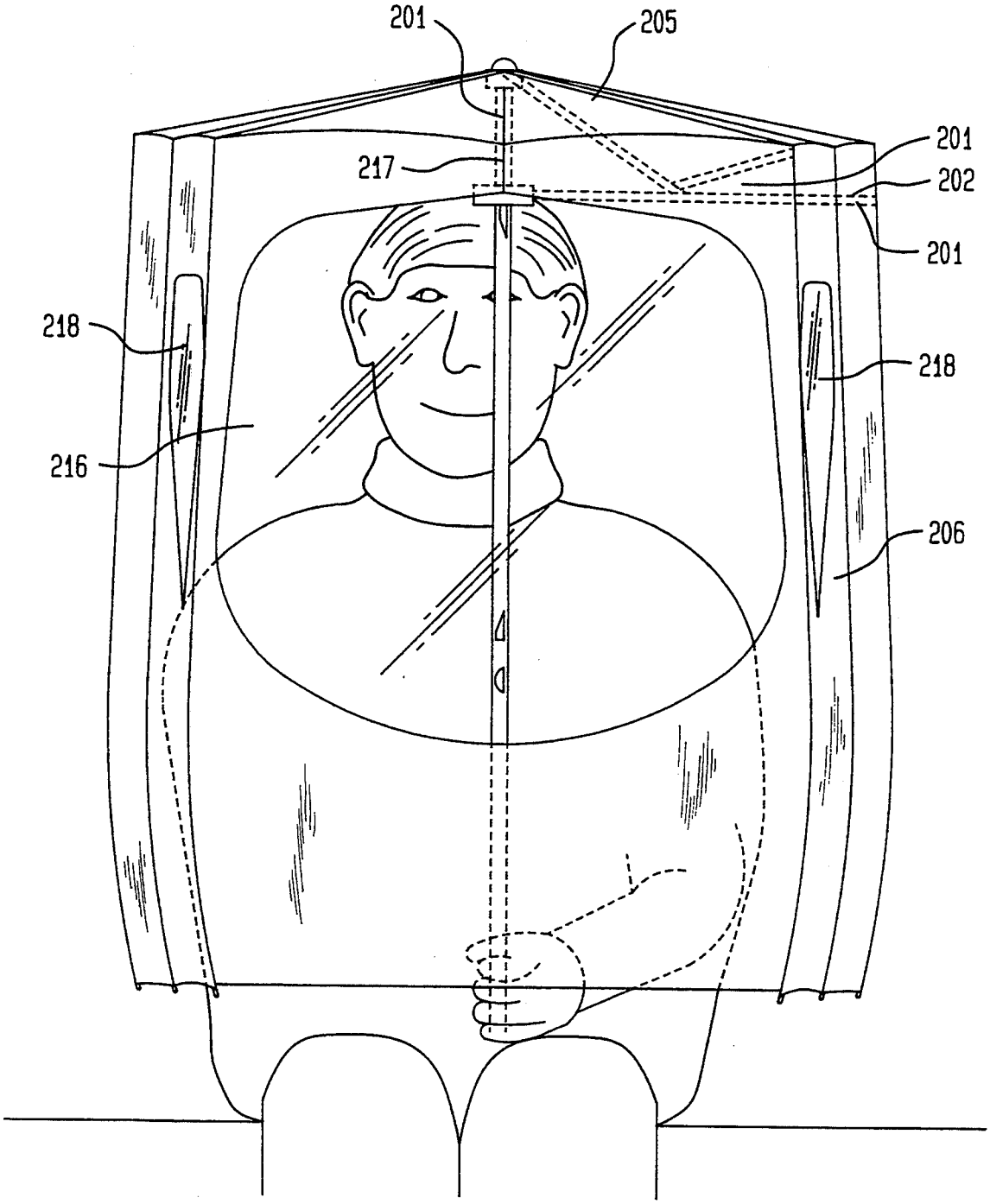
FIG. 16 is a front view of an alternate embodiment of the present invention wherein the canopy extends radially out and then bends down at the sides, front and rear with the front having a viewing opening which can be opened or made of clear plastic.
Figure 17:
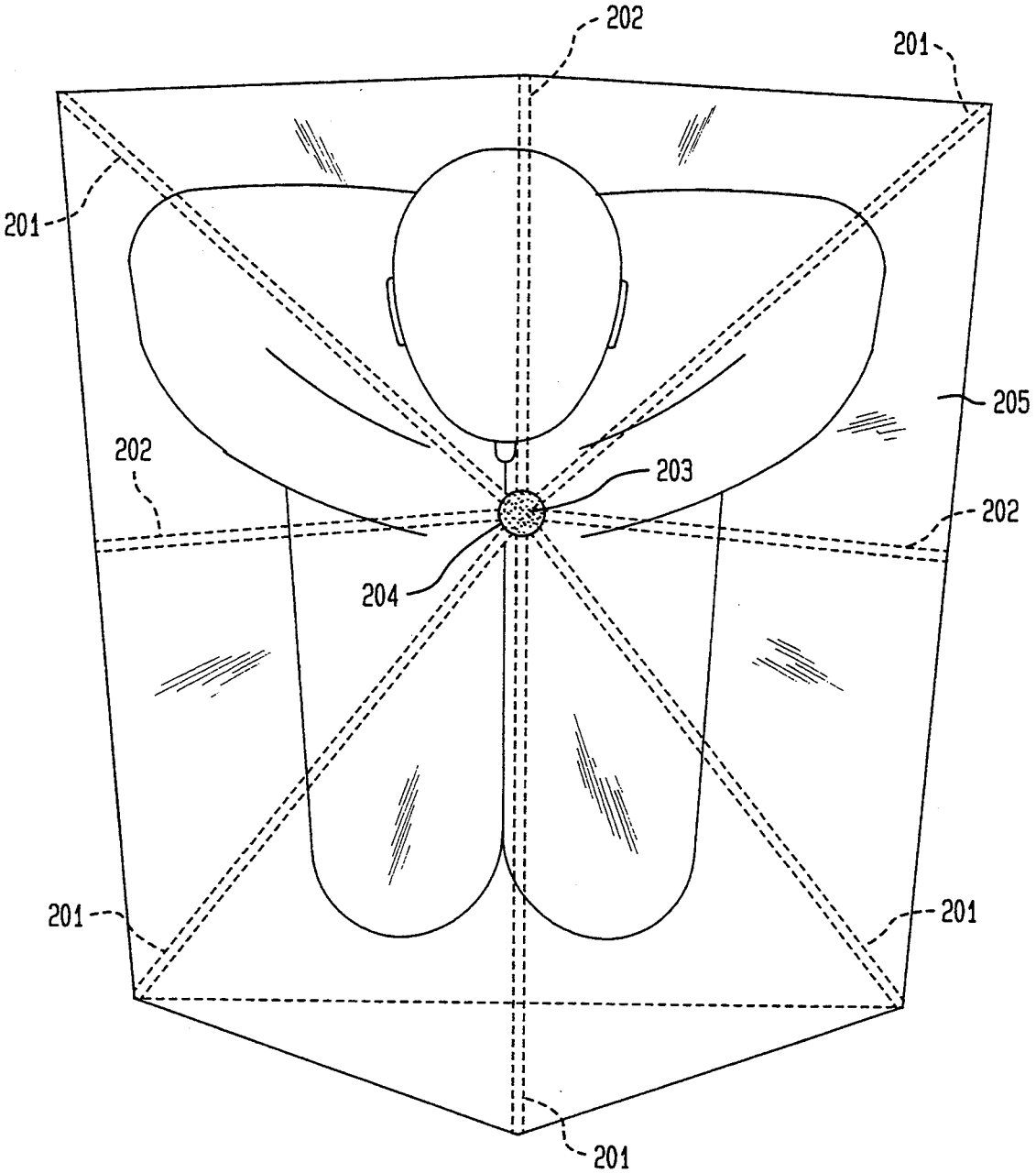
FIG. 17 is a top view of the embodiment of FIG. 16.

In the preferred embodiment, there are eight rib assemblies. The outer sections of each rib are the same length and approximately equal to the length of the shaft. Optionally, the forward rib is truncated to permit viewing. Alternately, as shown in FIG. 16, there can be a window in the front 216 and side windows 218. These can be completely opened or be made of a clear or transparent material. In operation, the slide shaft 204 is secured in the closed position by latch 213. The latch is released by release button 214. The shaft slide is latched in the open position after it passes over latch 219. The umbrella is closed by depressing latch 219 and pulling the slide shaft down toward the handle. In the preferred embodiment the canopy is attached to the top of the shaft and to both the ends of the outer rib section.

While exemplary embodiments of the invention have been described, the true scope of the invention is to be determined from the following claims.

What is claimed is:

1. An apparatus comprising:

a shaft comprising a handle end and a canopy end;

a canopy comprising a plurality of extension ribs, the ribs having a shaft end pivotally connected to the canopy end of the shaft and extending from the shaft to outer rib ends, and a canopy cover supported on the extension ribs and extending radially from the shaft to the outer rib ends, a shaft section and an outer rib section, there being at least one multi-position canopy rib having at least one multi-position rib hinge between the shaft section and the outer rib section, said canopy having a plurality of sections;

an actuating means for moving the canopy between:

a) an closed position where all of said ribs are closed and b) middle position where said outer rib section is folded towards said shaft end and said canopy ribs are extended c) an opened position where all of the ribs are fully opened;

means to latch the umbrella in said middle position;

means to latch the umbrella in the opened position wherein in said middle position, a section of said canopy is closed while other sections or said canopy are extended; and means to fasten the canopy when opened in the middle position in the inside windshield of an automobile.

2. The apparatus as recited in claim 1 wherein the automobile has a rear view mirror and the means to fasten is a strap on the top of the canopy disposed to removably connect the canopy to the rear view mirror of the automobile.

3. The apparatus as recited in claim 2 wherein the multi-position rib hinge further comprises:

a hinge body;

a restricter bar connected at a restricter bar hinge end to the hinge body at the hinge pivot, and connected to shaft section of the multi-position rib through a rotating slide, the rotating slide being capable of rotating about an axis through the rib and translating along the rib;

a stop means between the rotating slide and the hinge end to limit movement of the restricter bar toward the hinge;

a hinge piston bar connected to the hinge body at the piston pivot, and connected to the shaft section of the multi-position rib through a hinge piston bar housing coaxial to the rib; and a hinge push bar interconnected between the shaft slide and the hinge piston bar.

4. The apparatus as recited in claim 3 wherein the hinge push bar is connected at one end to the hinge piston bar.

5. The apparatus as recited in claim 3 wherein the hinge push bar is pivotally connected at an opposite end to a push bar slide, the push bar slide capable of translating along the rib.

6. The apparatus as recited in claim 5 further comprising a push bar strut pivotally connected between the shaft slide and the push bar slide.

7. The apparatus as recited in claim 3 wherein the push bar strut has an axial extension means.

8. The apparatus as recited in claim 1 wherein the automobile has a front seat and the means to fasten is the umbrella shaft pressed against the front seat of the automobile.

9. An apparatus a shaft comprising a handle end and a canopy end;

a canopy comprising a plurality of extension ribs, the ribs having a shaft end pivotally connected to the canopy end of the shaft and extending from the shaft to outer rib ends, and a canopy cover supported on the extension ribs and extending radially from the shaft to the outer rib ends, a shaft section and an outer rib section, there being at least one multi-position canopy rib having at least one multi-position rib hinge between the shaft section and the outer rib section, said canopy having a plurality of sections;

an actuating means for moving the canopy between:

a) an closed position where all of said ribs are closed and b) middle position where said outer rib section is folded towards said shaft end and said canopy ribs are extended c) an opened position where all of the ribs are fully opened;

means to latch the umbrella in said middle position; and means to latch the umbrella in the opened position wherein in said middle position, a section of said canopy is closed while other sections or said canopy are extended wherein said actuating means for moving said canopy means comprises:

the shaft having a top and a rib control strut pivotally connected to the shaft canopy end at a strut shaft end, and having a strut rib end pivotally connected to each of said ribs;

a shaft slide disposed to slide axially along the shaft, the shaft slide having a slide top facing the shaft canopy end, and a movable slide bottom which can be positioned and latched at the lower or upper end of the shaft slide;

a push bar slide disposed to slide along said multi-position ribs;

a push bar strut pivotally connected to the push bar slide at a strut rib slide end and pivotally connected to the shaft slide bottom at a strut shaft slide end;

the means to latch said multi-position rib in said middle position being the latching of the shaft slide bottom in its lower position on the shaft slide;

the means to latch said multi-position rib in said opened position being the latching of the shaft slide bottom in its upper position on the shaft slide; and a push bar connected to the push bar slide on one end and to the hinge piston bar on the opposite end of sufficient length to cause the multi-position hinge to close or partially close the rib portion which extends toward the multi-position hinge, and to cause the portion of the multi-position rib from the hinge to the end of the rib to be extended with the multi-position rib hinge opened upon the slide bottom being latched at the opened position.

10. The apparatus as recited in claim 9 wherein the multi-position rib hinge further comprises:

a means to rotate at least partially around a radial axis of the shaft end; and a means to rotate at an angle to the plane end section radially to the shaft end to open and close the end section.

* * * * *